US005517787A

United States Patent [19]

Mack

[11] Patent Number: 5,517,787

[45] Date of Patent: May 21, 1996

[54] REMOVABLE ENTRANCEWAY PUZZLE GATE

[76] Inventor: Edward Mack, P.O. Box 30, Chester, N.Y. 10918

[21] Appl. No.: 208,434

[22] Filed: Mar. 9, 1994

[51] Int. Cl.[6] ..... E01F 13/00

[52] U.S. Cl. ..... 49/34; 49/49

[58] Field of Search ..... 49/49, 34, 35; 160/327, 328

[56] References Cited

U.S. PATENT DOCUMENTS

| | | | |
|---|---|---|---|
| 1,241,364 | 9/1917 | Ferris . | |
| 2,153,708 | 4/1939 | Belsher . | |
| 2,306,661 | 12/1942 | Gengler | 49/34 X |
| 2,454,348 | 11/1948 | Schilling . | |
| 2,459,884 | 4/1948 | Kopf . | |
| 3,952,453 | 4/1976 | Amburgey . | |
| 4,321,770 | 3/1982 | Mullins, Jr. . | |
| 4,553,739 | 11/1985 | Baines | 49/34 X |
| 5,245,787 | 9/1993 | Swenson et al. | 49/34 |

*Primary Examiner*—Brian K. Green
*Assistant Examiner*—Jerry Redman
*Attorney, Agent, or Firm*—David Everett Meeks

[57] ABSTRACT

A removable barrier gate to block a driveway or doorway, that has at least two crossmembers that attach to either side of the opening, and a linking member that connects the inner ends of the crossmembers together, forming a continuous barrier across the opening.

10 Claims, 11 Drawing Sheets

REMOVABLE ENTRANCEWAY PUZZLE GATE

BACKGROUND—FIELD OF INVENTION

This invention relates to linking entranceway gates, specifically to gates used across an entranceway or door opening, which can be quickly and easily installed or removed.

BACKGROUND—DESCRIPTION OF PRIOR ART

Many entranceways and door openings exist that must be closed off at times to traffic or the movement of vehicles or other traffic. Homeowners and businesses require barrier gates for security reasons, especially at night or other times when security risks are highest.

Passageways, doors, and driveways have been commonly blocked off with heavy metal swinging gates, or by the use of sliding or swinging chainlink fences. At other times, a cable is stretched across the opening and attached at both ends, forming a barrier device. At other times, barriers are placed in the opening, such as rocks or other heavy objects.

All of the common methods suffer from a number of disadvantages. The gate and chain link fences are expensive and at times unsightly for the given application. The other barriers, including a stretched cable or heavy objects, are unsightly and impractical for most homeowners or businesses.

Other types of security bar systems have been proposed—such as U.S. Pat. Nos. 4,321,770 to Mullins, Jr. or 2,439,884 to Kopf or 3,952,453 to Amburgey. These barrier systems use a bar or several bars and couplings to span an opening between two structural members on either side. These systems, developed for industry or the home, are known to suffer from a number of disadvantages:

(a) The bars and other parts of these systems form a permanent barrier that is installed for permanent or semi-permanent installations. Their parts, having been installed, are not meant to be removable and replaceable on an ongoing basis.

(b) The bars and parts of the disclosed barriers have the appearance of industrial parts, and therefore are not acceptable for many uses or applications where appearance is important to the user.

(c) The barrier systems require special tools and special installation methods in order to construct the apparatus in the intended fashion.

OBJECTS AND ADVANTAGES

Accordingly, several objects and advantages of the present invention are:

(a) To provide an attractive gate that can be used in surroundings requiring an attractive appearance, such as homes or estates.

(b) To provide a gate that can not be removed and is extremely durable and resistant to tampering.

(c) To provide a gate that can be quickly and easily removed and stored when the gate is not needed.

(d) To provide a gate that can be quickly and easily removed to open the drive, and the just as quickly and easily replaced to its original installed position.

(e) To provide a gate that can be easily operated requiring little expertise or special tools.

(f) To provide a gate that can be disassembled and shipped conveniently to any distant location.

(g) To provide a gate that has an attractive appearance, whose appearance can be further improved by the addition or attachment of decorative materials.

(h) To provide a gate that can be assembled from several or many common stock parts without the requirement of making special sizes to accommodate an application.

DRAWING FIGURES

Figure 2:
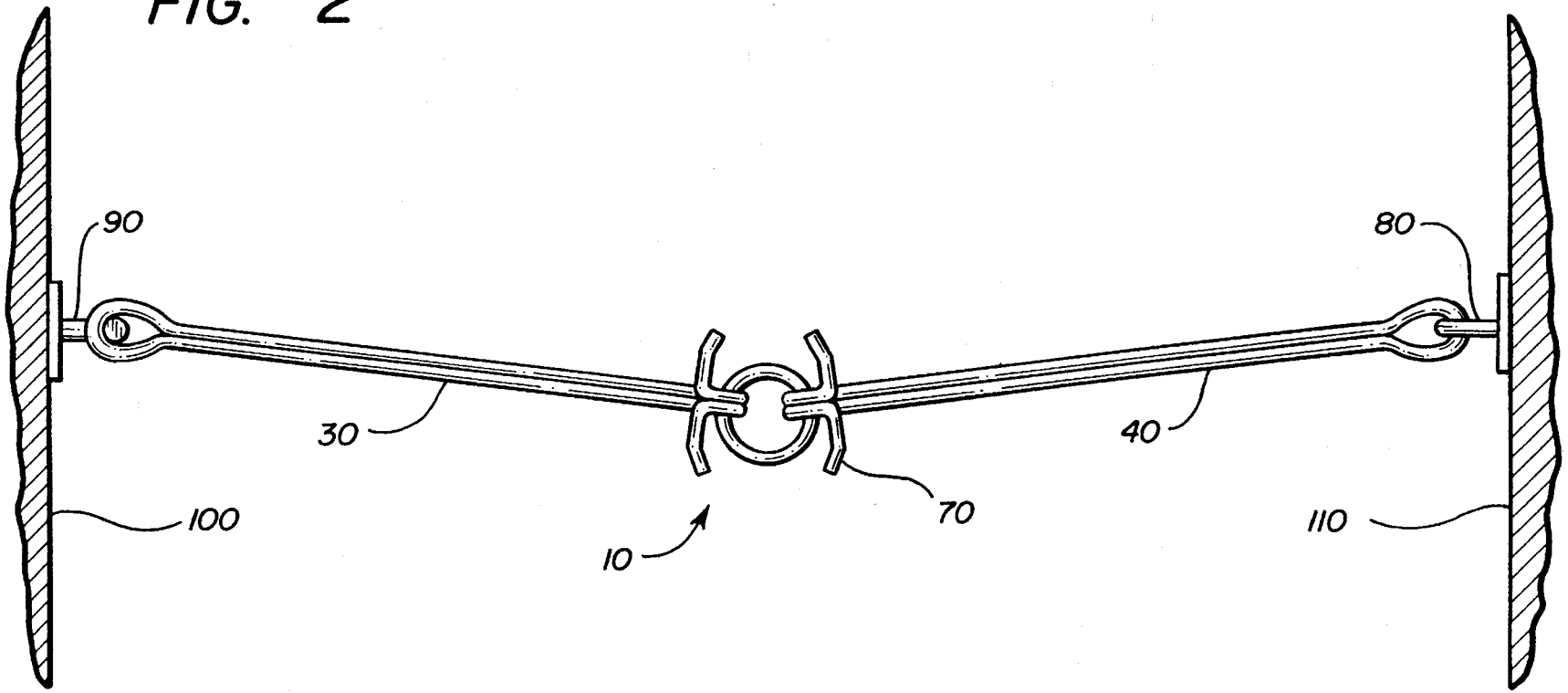
FIG. 2 shows the parts of FIG. 1 installed across an opening.
Figure 2A:
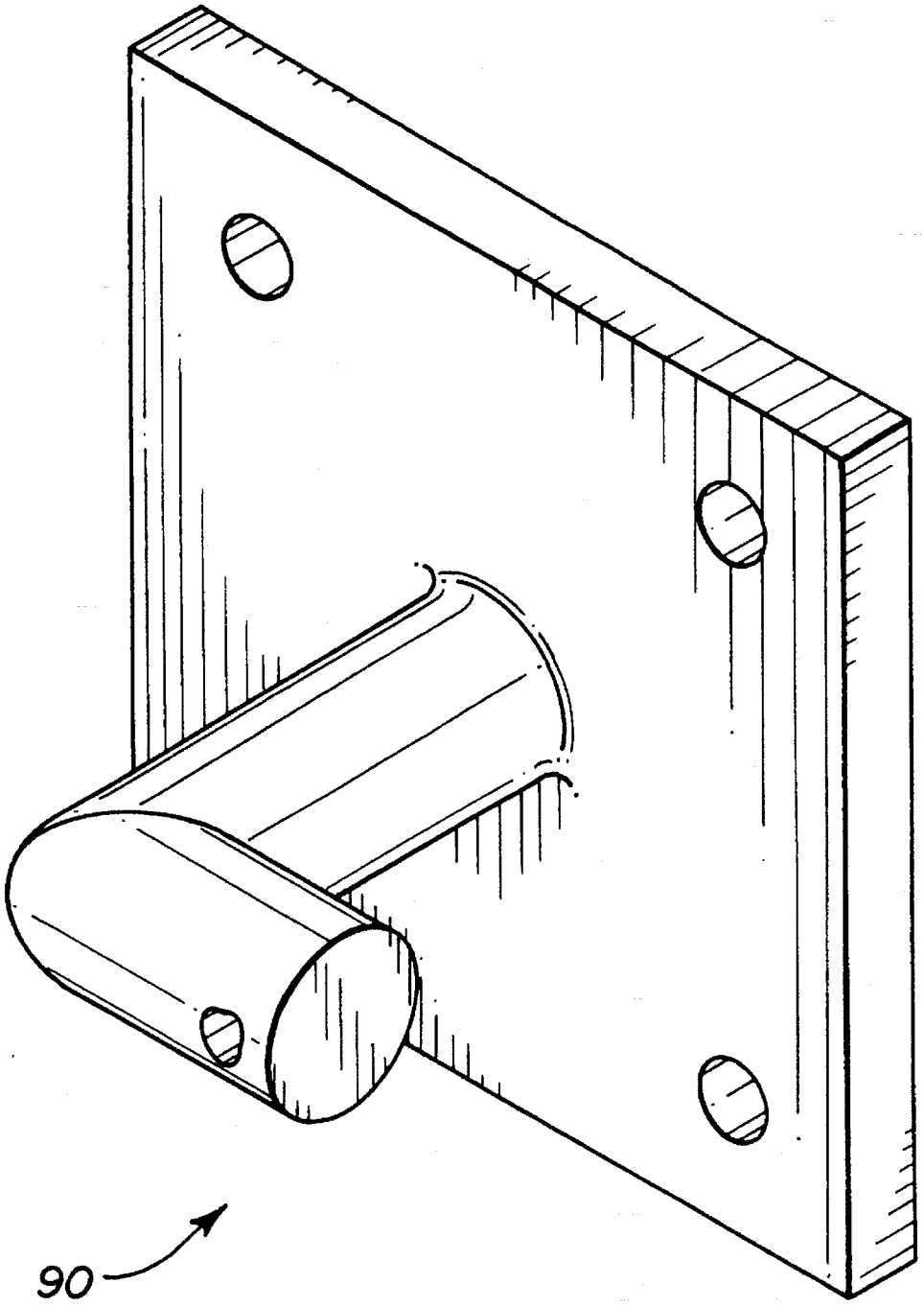

FIG. 2A showing the locking connector 90.

Figure 3:
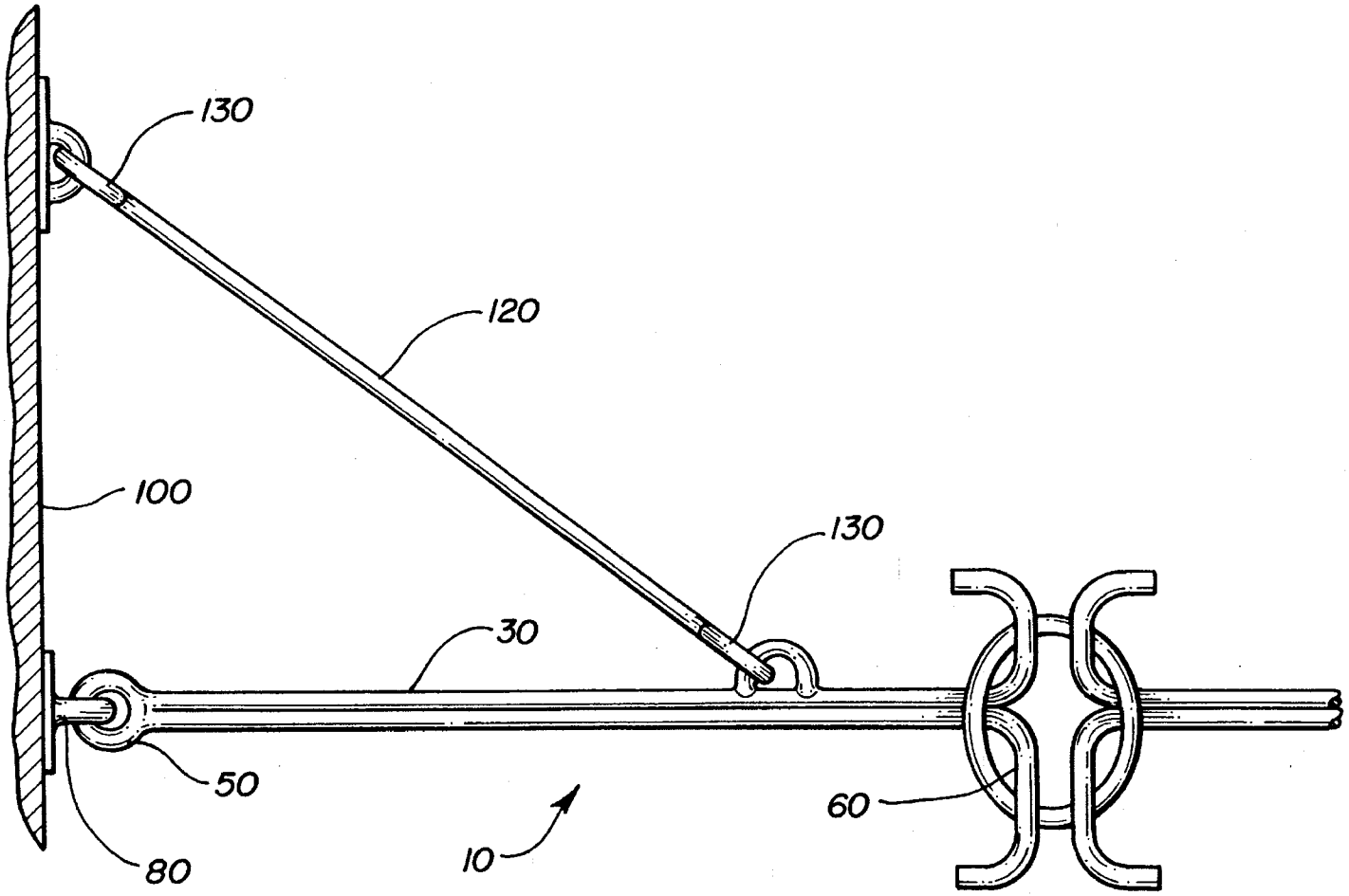

FIG. 3 shows a gate with the additional outrigger component.

Figure 4:
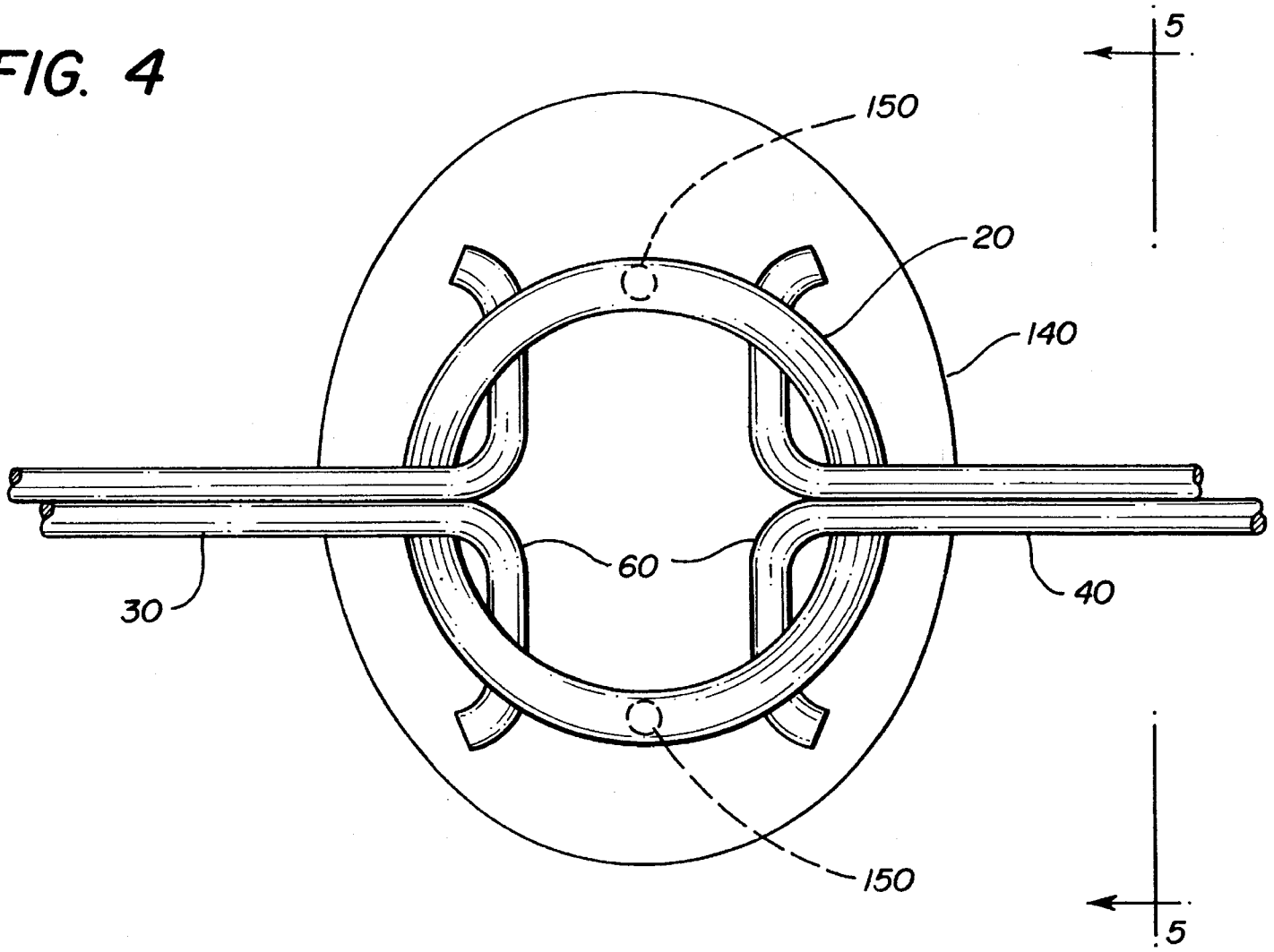

FIG. 4 shows a center link with an attachment piece.

Figure 5:
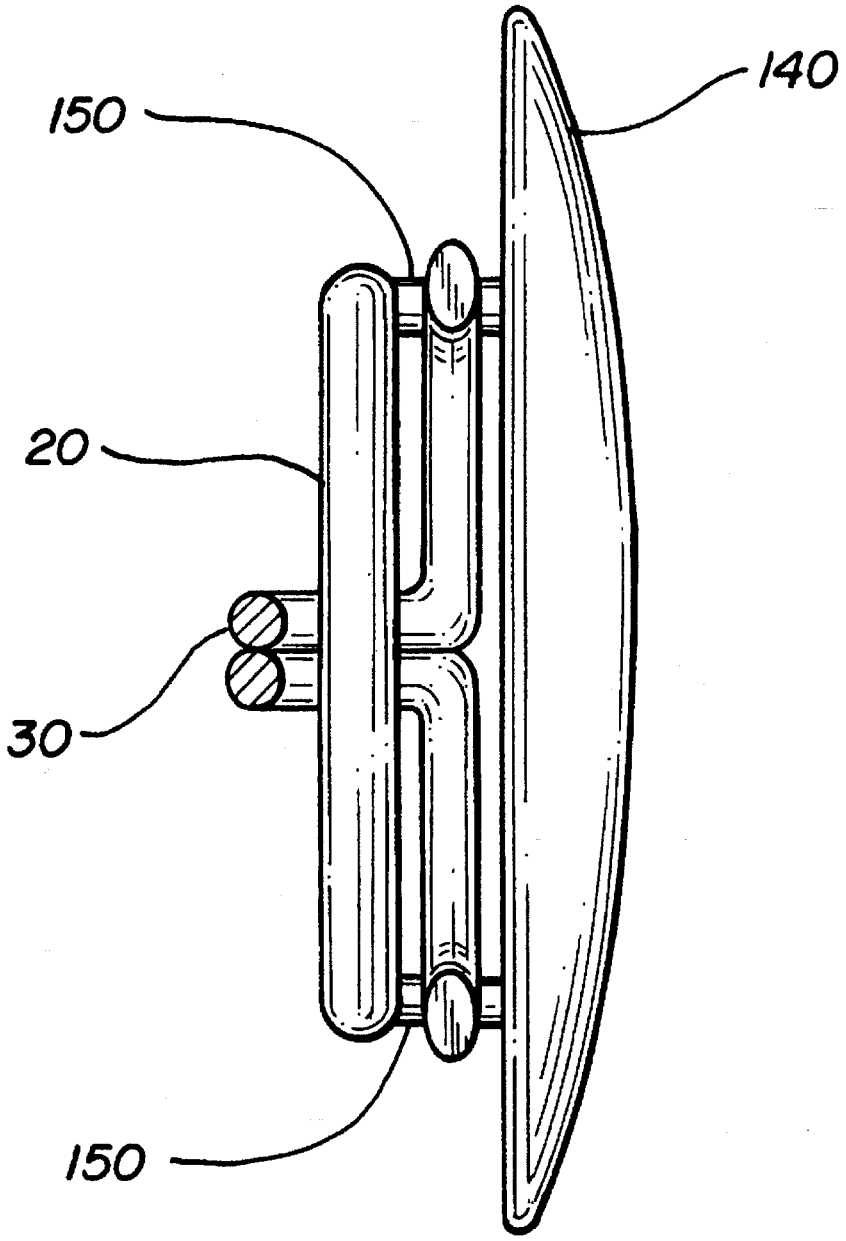

FIG. 5 shows a side view of FIG. 4.

Figure 6:
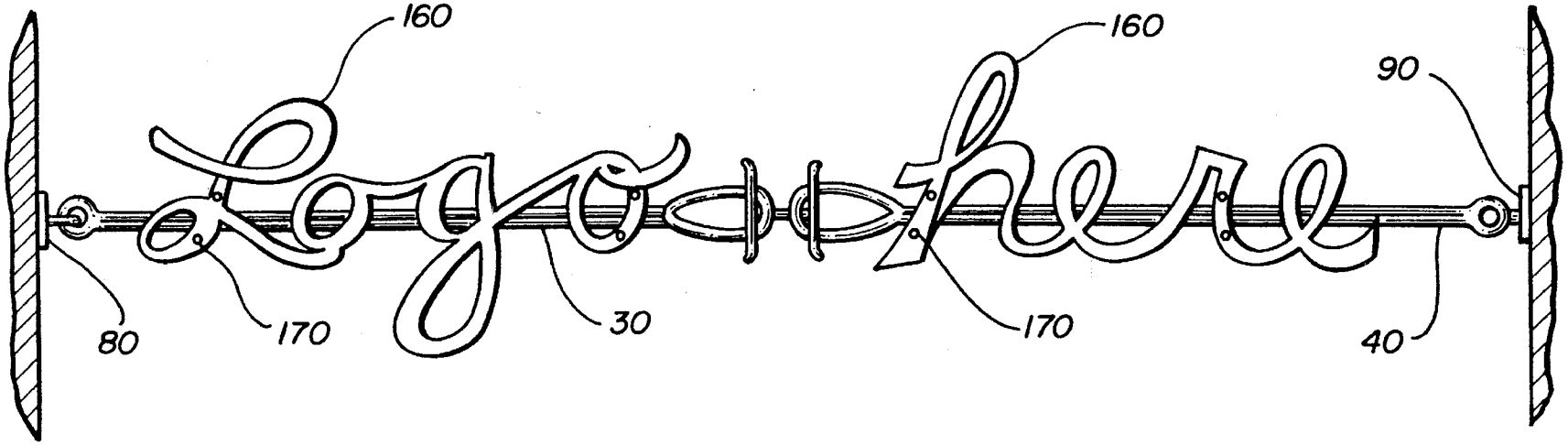

FIG. 6 shows a front view with special attachment pieces.

Figure 7:
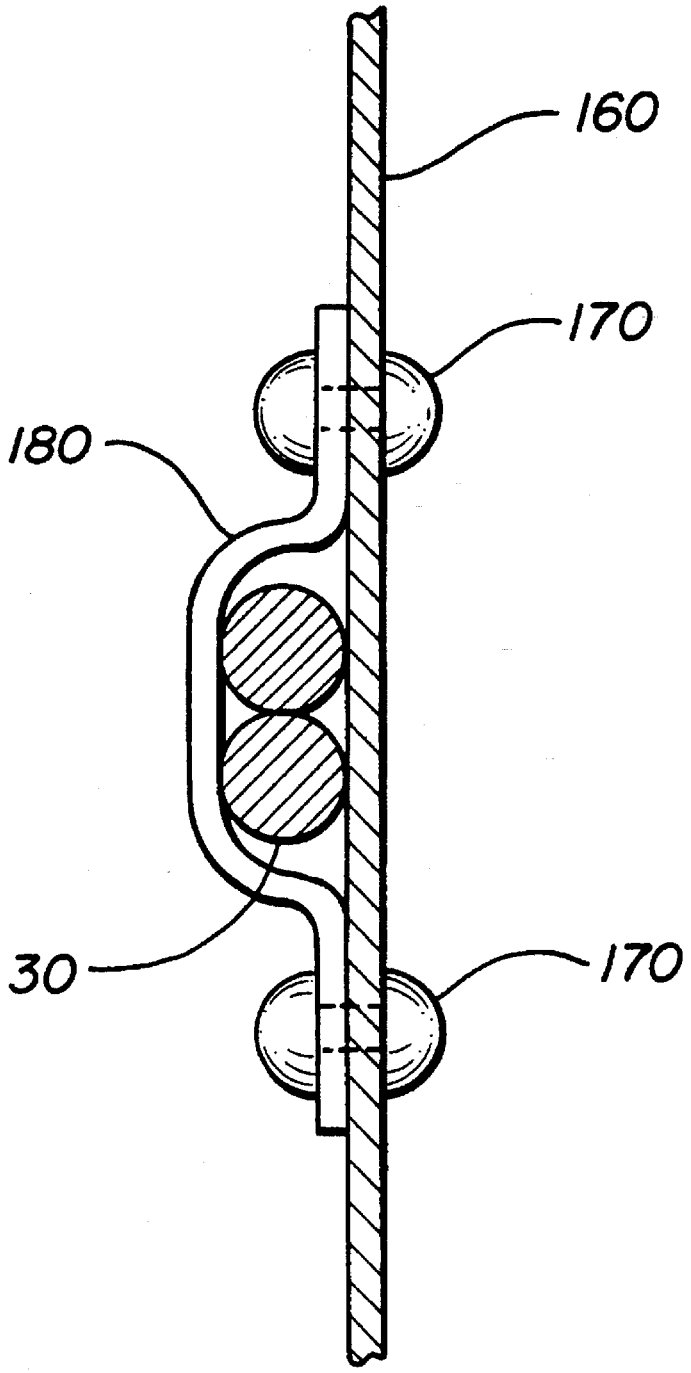

FIG. 7 shows the method of attaching the attachment pieces.

Figure 8:
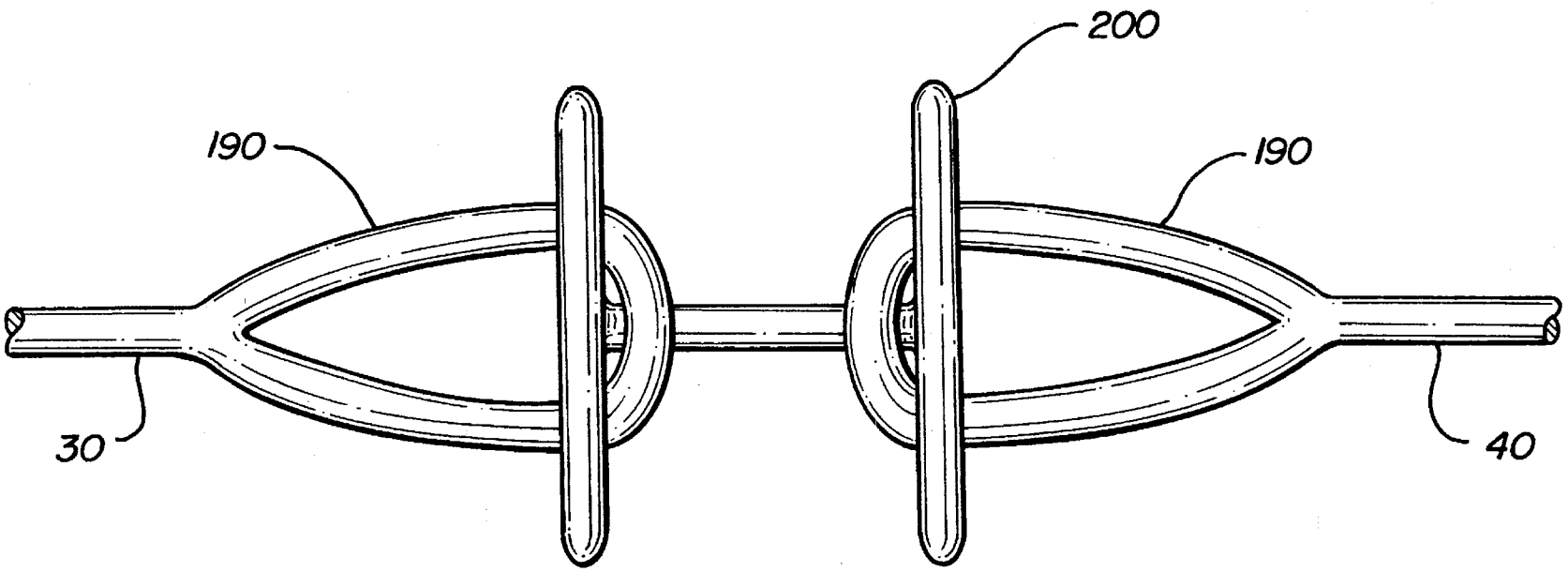

FIG. 8 shows the center connection of the gate in FIG. 6.

Figure 9:
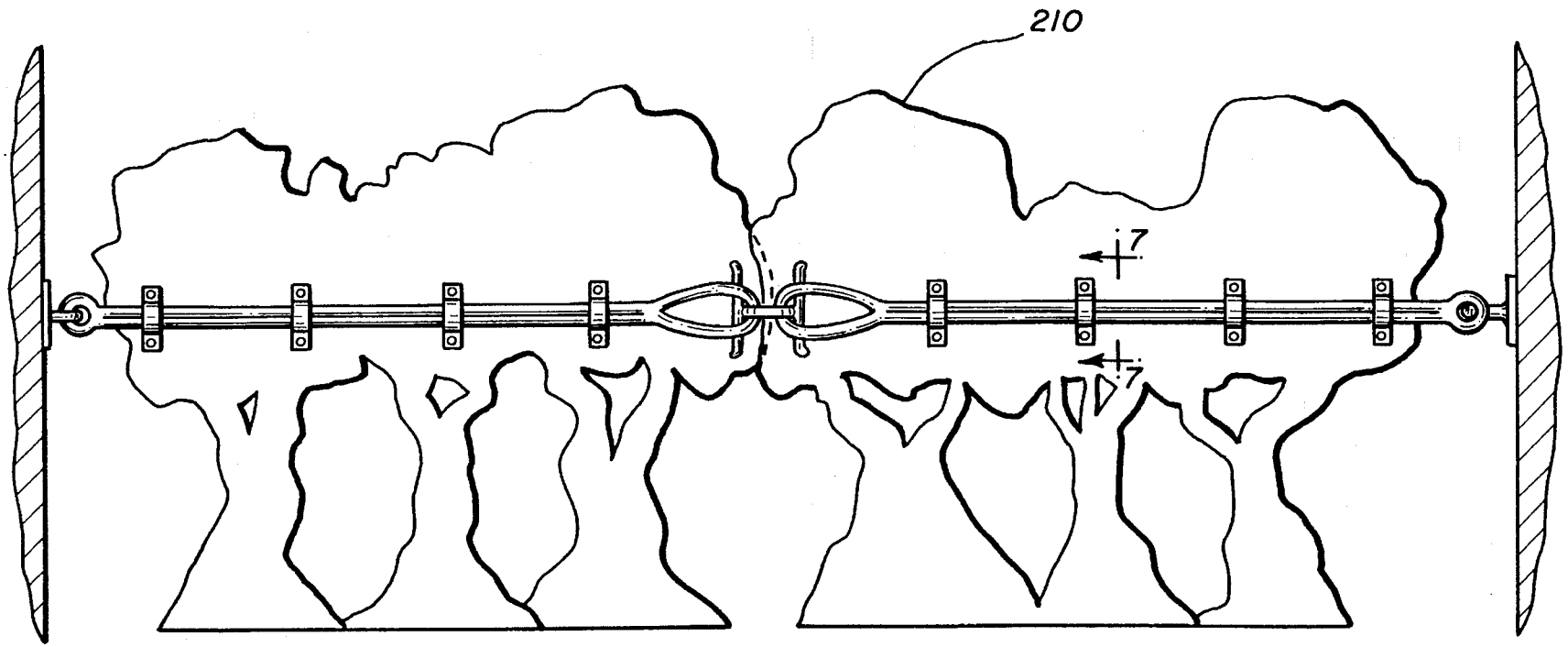

FIG. 9 shows the gate in FIG. 6 with ornamental attachment pieces.

REFERENCE NUMERALS IN DRAWINGS

10 Gate assembly
20 Center link connector
30 First cross member
40 Second cross member
50 Eyelet end
60 Hook end
70 End extension
80 Eyelet connector
90 Locking connector
100 Left structural member
110 Right Structural member
120 Outrigger strut
130 Outrigger strut eyelet end
140 Decorative cover plate
150 Attachment bolts
160 Decorative material
170 Attachment bolt
180 Backing plate
190 Eyelet end
200 Attachment connector
210 Alternate decorative material

DESCRIPTION—FIGS. 1 TO 5

Figure 1:
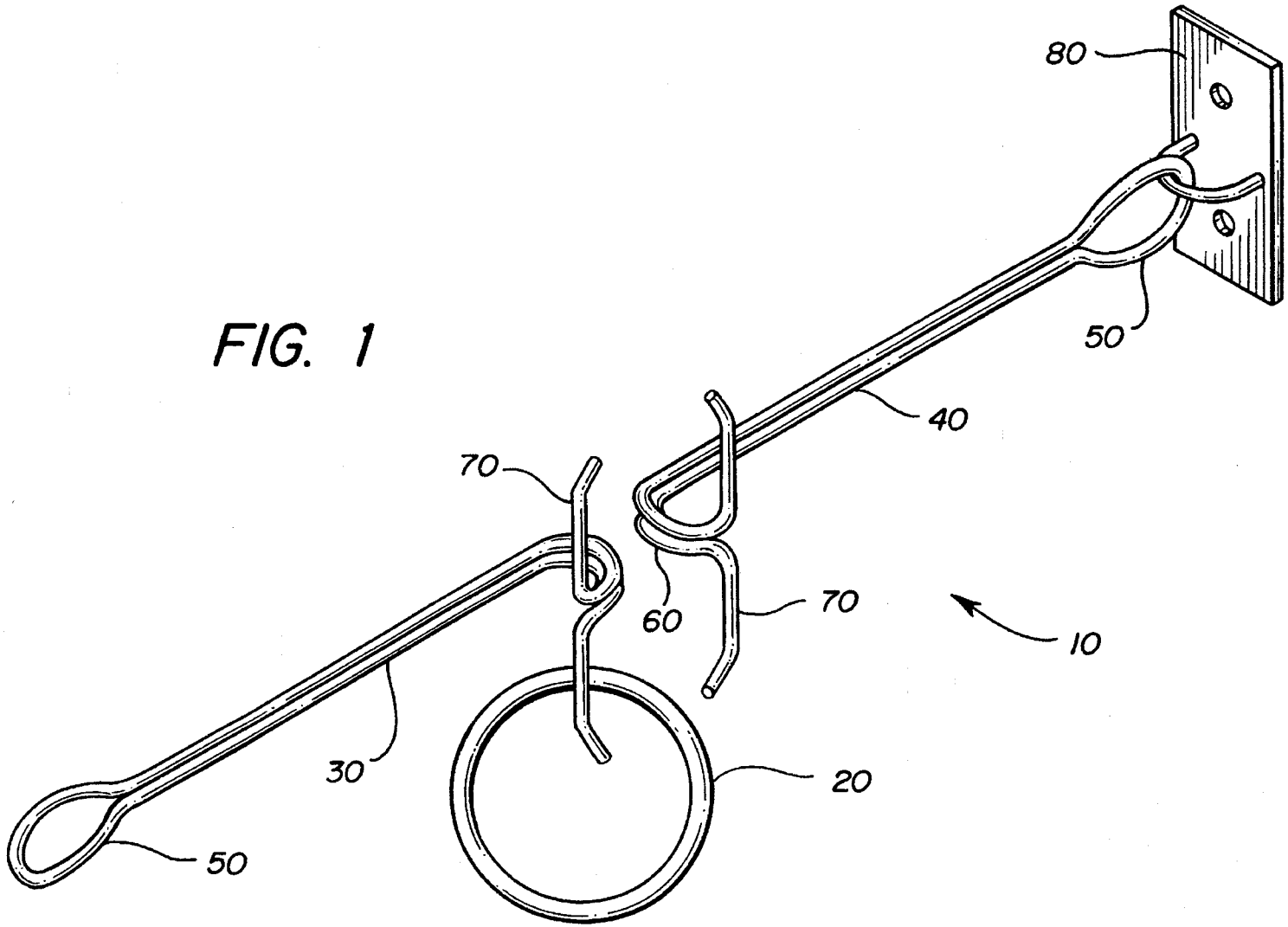
FIG. 1 shows the parts that make up a gate.
Figure 1A:
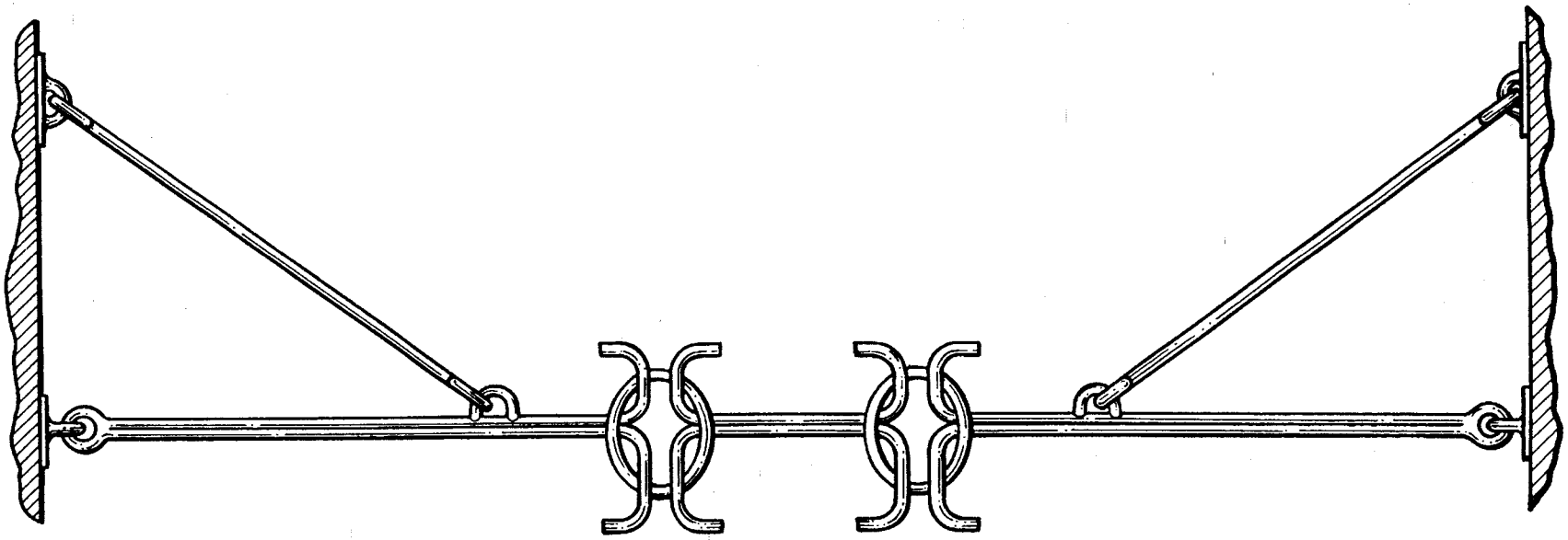
FIG. 1A shows the parts that make up the gate, including additional cross members and connecting links.

A typical embodiment of the removable entranceway puzzle gate of the present invention is illustrated in FIGS. 1 and 1A (perspective view), FIG. 2 (installed), FIG. 2A (locking connector 90), FIG. 3 (with outrigger), FIG. 4 (with cover plate), and FIG. 5 (side view with cover plate).

FIG. 1 and FIG. 2 shows a complete gate assembly 10 of the preferred embodiment of the invention. The gate assembly has a torus shaped center link connector 20. The gate has a first cross member 30 and a second cross member 40. Both cross members 30, 40 have an outer eyelet end 50 and an inner hook end 60. The inner hook end 60 has an end extension 70 that lengthens the inner hook end, and is done for decorative purposes. The outer eyelet end 50 of cross member 30 is rotatably attached to an eyelet connector 80. The outer eyelet end 50 of cross member 40 is attached to an L shaped locking connector 90, shown in FIG. 2A. The eyelet connector 80 is attached by means of screws to the left structural member 100. The locking connector 90 is attached to the right structural member 110 by screws. A padlock (not shown) can be placed on the end of locking connector 90 to prevent removal of its associated eyelet end 50.

FIG. 2 shows the gate assembly 10 installed between a left structural member 100 and a right structural member 110. The structural members can be any appropriate structural support such as a post, tree, or a wall. The eyelet connector 80 is attached by means of screws, bolts or welding to the left structural member 100. A locking connector 90 is attached by means of screws, bolts or welding to the right structural member 110. The locking connector 90 is an L-shaped part that fits into the eyelet end 50. A hole is drilled in the end of the L-shaped part adapted to fit a padlock. When the padlock is placed through the hole and locked, the eyelet end 50 can not be removed from the locking connector 90.

FIG. 3 shows a similar gate assembly 10 as shown in FIGS. 1–2, with the addition of an outrigger strut 120 connected between the first cross member 30 and the left structural member 100. The outrigger strut 120 has both ends formed into the shape of an eyelet 130. These eyelets are adapted to connect to respective connectors on the left structural member 100 and the first cross member 30. The connector on the left structural member 100 is placed some distance above the eyelet connector 80, and the connector on the first cross member 30 is placed at a point between the eyelet end 50 and the hook end 60. As can be appreciated, a similar outrigger strut 120 can be placed between the second cross member 40 and the right structural member 110 (not shown).

FIGS. 4–5 shows the center link connector 20 and the two hook ends 60 from the first and second cross members 30, 40. Additionally, a decorative cover plate 140 is attached to the center link connector 20 by means of attachment bolts 150.

There are various additional possibilities with regard to construction of the gate. Additional cross members can be made that have, instead of an eyelet end 50 and a hook end 60, two hook ends 60 (not shown). Additional center link connectors 20 can be used to connect the additional cross members. This construction is a linked configuration where a puzzle gate is constructed from a first and second cross member 30, 40, additional cross members with only hooked ends 60, and a center link connector 20 for each mating pair of hooked ends. As the reader can appreciate, there is no limit to the number of cross members that can be connected together to form the gate. As an example, a gate may consist of a first cross member 30 and a second cross member 40, both having a eyelet end 50 and a hook end 60. A third cross member having two hooked ends 60 is positioned between the first and second cross members 30, 40. The third cross member is linked to the first cross member 30 by a center link connector 20; the third cross member is also linked to the second cross member 40 by a second center link connector 20. Additional cross members with hooked ends and center link connectors can be added to make the gate even longer.

From the description above, a number of advantages of the removable entranceway puzzle gate become evident:

(a) The gate has a pleasing appearance and can be appropriately used on estates or homes where aesthetic considerations are important.

(b) The gate can be easily constructed in place and used without the need for special skills or tools, and can just as easily be removed and set aside.

(c) The gate parts can be manufactured in one or several lengths, and then linked together to accommodate many or all possible gate openings.

(d) The gate can be made from any number of attractive materials in any number of attractive shapes.

OPERATION—FIGS. 1–5

The manner of using the removable entranceway puzzle gate is as follows:

(a) A left and right structural member 100, 110 is used to support the gate, as shown in FIG. 2. These supports, substantially vertical and parallel, must be adequate to support the gate.

(b) On the left structural member 100 an eyelet connector 80 is attached by suitable means, such as screws, bolts, or welding. The connector is positioned to accept the eyelet end 50 of a cross member.

(c) A locking connector 90 is attached by any suitable means, such as screws, bolts, or by welding, to the right structural member 110 at the same height above the floor as the eyelet connector 80 is located. The locking connector 90 shown in FIG. 2A is positioned to accept the eyelet end 50 from a cross member.

(d) The first cross member 30 engages the eyelet connector 80 by its eyelet end 50.

(e) The center link connector 20 is now slipped over the hook end 60 of the first cross member 30.

(f) The hook end 60 of the second cross member 40 is slipped into the center link connector 20 in the same manner as the hook end 60 of the first cross member 30.

(g) The eyelet end 50 of the second cross member 40 is placed into the locking connector 90.

(h) A lock is placed through the locking connector 90 to secure the gate in place.

Where an outrigger strut 120 is necessary or desirable, it is attached by means of eyelets 130 to the appropriate structural member 100, 110 and cross member 30, 40, as shown in FIG. 3.

Additionally, a decorative cover plate 140 can be attached to the center link connector 20 by means of attachment bolts 150, as shown in FIGS. 4–5.

DESCRIPTION—FIGS. 6–9

As shown in FIGS. 6 and 9, decorative materials 160 can be used with the gate. This is done by making decorative materials in a shape that can be attached to the cross members 30, 40 by any suitable attachment means. In FIG. 6 the decorative material is shown to be two words; one word is attached to the first cross member 30 and the second word is attached to the second cross member 40.

In FIG. 9 the decorative material 210 is shown as a mural-like natural scene. Two separates portions are attached; one to the first cross member 30 and one to the second cross member 40.

The decorative materials 160, 210 in FIGS. 6 and 9 are attached to the cross members 30, 40 by any suitable attachment means. One method is to use backing plates 180 as shown in FIG. 7. These plates mount on the opposite side of the cross members as the decorative materials. Attachment bolts 170 are used to attach the backing plate 180 to the decorative material 160, sandwiching the cross member 30 in between. Several or many backing plates 180 and attachment bolts 170 can be used on each piece of decorative material 160.

A different type of center link connector is depicted in FIG. 8. To distinguish this connector from the center link connector 20, it referred to as attachment connector 200. This connector is used with cross members 30, 40 that have eyelet ends 190 instead of hook ends 60. The attachment connector 200 is an H-shaped part adapted to engage the eyelet ends 190 as shown in FIG. 8.

OPERATION—FIGS. 6–9

The gate shown in FIGS. 6–9 is erected in much the same fashion as the gate shown in the FIGS. 1–5. The decorative materials 160, 210 are bolted in place using attachment bolts 170 and backing plates 180. The decorative materials could also be welded into place.

The attachment connector 200 shown in FIG. 8 is used by engaging the connector into the two eyelet ends 190 of the cross members 30, 40. The eyelet ends 50 of the cross members are attached in the same manner as the gate in FIG. 2.

The reader can appreciate that the addition of the decorative materials 160, 210 has the following advantages:

(a) The gate can have a more attractive appearance by incorporating the name or symbols of the owners. These decorations may also help in identifying the residence from the road.

(b) The gate can incorporate mural-like depictions that are more attractive than a bare gate structure.

SUMMARY, RAMIFICATIONS, AND SCOPE

Accordingly, the reader will see that the removable entranceway puzzle gate of this invention can be used to close-off and secure any number of openings, including driveways and doorways. The gate has an attractive appearance and can incorporate additional decorative materials to further improve its appearance. Furthermore, the entranceway gate has additional advantages in that:

(a) It can be easily erected and then moved into and out of position easily and quickly, depending upon the needs of the user.

(b) It can be assembled from any number of interconnecting members to accommodate any number of openings.

(c) It provides a secure yet easily removable closure that is attractive, durable, and simple to operate.

Although the description above contains many specifications, these should not be construed as limiting the scope of the invention but as merely providing illustrations of some of the preferred embodiments of this invention. For example, the gate cross members and connectors can have other shapes that form a gate assembly for driveways, doorways, or other openings.

Thus the scope of the invention should be determined by the appended claims and their legal equivalents, rather than by the examples given.

What is claimed is:

1. A removable entranceway gate installed between two spaced apart left and right structural members, said entranceway gate comprising:

(a) a plurality of elongated cross members, each member having ends, wherein said cross members are placed in a row with their ends mating forming pairs of opposed ends, wherein said row is arranged between said structural members and spanning the distance between said structural members, and wherein a gap is defined between each cross member pair of opposed ends, thereby resulting in sets of opposed ends forming said gaps and a single end adjacent each structural member;

(b) connector means associated with each structural member and attached thereon;

(c) wherein said single ends adjacent said structural members are formed into the shape of an eyelet, and wherein said eyelet is pivotably and removably attached to its associated structural member by said connector means;

(d) wherein each paired end of said cross members is formed into the shape of a hook; and (e) connecting links placed in said gaps between said opposed hooked ends and linking said hooks together whereby a continuous gate is formed between said structural members by the linking together of cross members with connecting links into a chain that is connected between said structural members, wherein said assembly is completely disassembleable and removable into its constituent parts.

2. The removable entranceway gate of claim 1, where said connector links are formed into the shape of a torus.

3. The removable entranceway gate of claim 1, further comprising:

at least one outrigger strut having a first end and a second end, wherein said strut is adapted to engage a structural member on its first end and a cross member on its second end, thereby supporting the weight of the gate.

4. The removable entranceway gate of claim 1, further comprising removable, decorative cover plates attached to said connector links.

5. The removable entranceway gate of claim 1, further comprising decorative materials attached to said gate system.

6. The removable entranceway gate of claim 5, wherein said decorative materials comprise at least two portions attached to different cross members.

7. The removable entranceway gate of claim 5, further comprising backing plates mounted on said gate, wherein said decorative materials are attached to said gate system by said backing plates.

8. The removable entranceway gate of claim 1, where said cross member ends formed into the shape of a hook further extend to form a decorative portion.

9. A gate mounted between first and second structural members comprising:

(a) a plurality of elongated cross members having ends and arranged in a row between said structural members with said cross member ends mating forming sets of opposed ends, wherein said cross members span the distance between said structural members and form a gap between each set of opposed ends, and where said ends adjacent said structural members are formed into the shape of an eyelet, and the remaining ends are formed into the shape of a hook, thereby forming pairs of opposed hooks with a gap therebetween;

(b) connector means associated with each structural member and attached thereon, said connector means pivotally and removably connecting said eyelet ends of said cross members to their respective structural member; and (c) connecting link members, one associated with each pair of opposed hooked ends, in the gaps between said pairs and linking them together;

whereby a removable gate is formed from the combination of cross members and connecting links.

10. A removable gate pivotably connected between two structural members comprising:

(a) a connector means associated with each structural member;

(b) elongated cross members having ends; and (c) connecting link members;

where said cross member ends are shaped to form eyelets, and said cross members are arranged in a row with their ends mating with a gap therebetween to form sets of opposed eyelets, wherein the combination of said cross members spans the distance between said structural members, and said eyelet ends adjacent said structural members are connected to said structural members by said connector means, and said linking members are formed into the shape of an H having left and right sides, and said linking members are placed into said gap between said opposing sets of eyelets, with the left and right side of said link each engaging an eyelet, thereby linking said cross members together.

* * * * *